United States Patent [19]

Lippert

[11] 4,291,871

[45] Sep. 29, 1981

[54] EXERCISING AND METHOD FOR EXERCISING FINGER, HAND AND ARM MUSCLES

[76] Inventor: Wilmot T. Lippert, 1075 E. North St., Galesburg, Ill. 61401

[21] Appl. No.: 173,024

[22] Filed: Jul. 28, 1980

[51] Int. Cl.[3] ..... A63B 23/00; A63B 21/30

[52] U.S. Cl. ..... 272/68

[58] Field of Search ..... 272/67, 68, 135, 136, 272/137, 138, 142, 117, 78, 133

[56] References Cited

U.S. PATENT DOCUMENTS

| | | | |
|---|---|---|---|
| 967,403 | 8/1910 | Marley | 272/142 |
| 1,137,349 | 4/1915 | Patterson | 272/136 |
| 1,676,061 | 7/1928 | Strom | 272/142 X |
| 2,441,904 | 5/1948 | Schwarzmayr | 272/68 |
| 4,157,827 | 6/1979 | Winston | 272/117 |
| 4,218,057 | 8/1980 | Wilson | 272/117 |

*Primary Examiner*—Richard J. Johnson
*Attorney, Agent, or Firm*—McCaleb, Lucas & Brugman

[57] ABSTRACT

A finger, hand and arm muscle exerciser having a horizontal base plate with a stanchion post extending upwardly from the back edge. A horizontal cross-bar extends forwardly from the top of the post and has a coil spring hung from it along a vertical axis which intersects a central portion of the base plate for stability. A hand grip, generally similar in appearance to a bicycle handlebar grip, and made of a squeezable rubber-like material, is hung from the bottom of the spring to a position spaced sufficiently above the base plate to allow room for downward movement of the hand grip against the bias resistance of the spring. In use, the exerciser is placed on a horizontal surface such as a table or desk top. The user grasps the hand grip between the fingers, palm and thumb. Then, sqeezing forces are applied sequentially to the hand grip by the individual fingers, starting with the first or forefinger and ending with the fourth or little finger while simultaneously pulling the hand grip downwardly toward the base plate against the bias of the spring and maintaining the elbow braced against the table or desk top surface adjacent the base plate.

5 Claims, 3 Drawing Figures

EXERCISING AND METHOD FOR EXERCISING FINGER, HAND AND ARM MUSCLES

BACKGROUND OF THE INVENTION

This invention relates generally to exercisers. More specifically, it relates to a portable exercising device and a method of using it to exercise muscles concerned with movement of the fingers, hands and arms.

Persons suffering from arthritis in the hands and wrists, and some stroke victims, lose mobility of the finger and wrist joints. The condition often worsens in a kind of vicious circle as pain of moving the joints, or simple inability to do so, causes them to be moved less and the lack of exercising movement further weakens the muscles so they are less able to move the joints. This can be quite severe where a person has been burdened by the disease or inability for a long time. It can result in an almost complete lock-up of one or more joints. Where this condition persists over a period of years, muscle degradation can extend to some extent to most of the muscles concerned with movement of the fingers, hands, and arms. This can involve even the great pectoralis major muscles on the upper chest, and the trapezius and deltoid muscles on the shoulders and upper back.

Conventional treatment for hand and wrist joints which have lost or are losing mobility is to attempt to increase muscle strength by hand-squeezing procedures. Typically, squeezing pressure is exerted by the hand on an elastic ball or cylinder, or such squeezing movements are practiced in air without the elastic member. Unfortunately, benefits of this procedure are slow to achieve, are seldom substantial, and are limited to a few muscles in the hand and lower forearm. This situation is accordingly in need of an improvement.

SUMMARY OF THE INVENTION

Therefore, a principal object of the present invention is to provide wider and more effective exercise to persons suffering from stiff hands and wrists due to limited mobility of their joints caused by arthritis, strokes, or other ailments.

Another object of the invention is to provide an exercising device, and a method of using it, which effectively exercises most of the muscles concerned with moving the fingers, hands and arms, including certain important muscles in the back, chest and shoulders.

Another object is to provide such an exercising device which is readily available to those who need it by reason of its portability, simple and inexpensive construction, and simplicity and ease of use.

Other objects and advantages of the invention will appear as the description proceeds.

To accomplish the above and related objects, this invention may be embodied in the form illustrated in the accompanying drawing, attention being called to the fact however that the figures of the drawing are illustrative only, and that changes may be made in the specific construction illustrated and described within the scope of the appended claims.

BRIEF DESCRIPTION OF THE DRAWING FIGURE

The figures in the drawing are briefly described as follows.

Like parts are designated by like reference numerals throughout the figures of the drawing.

Figure 1:
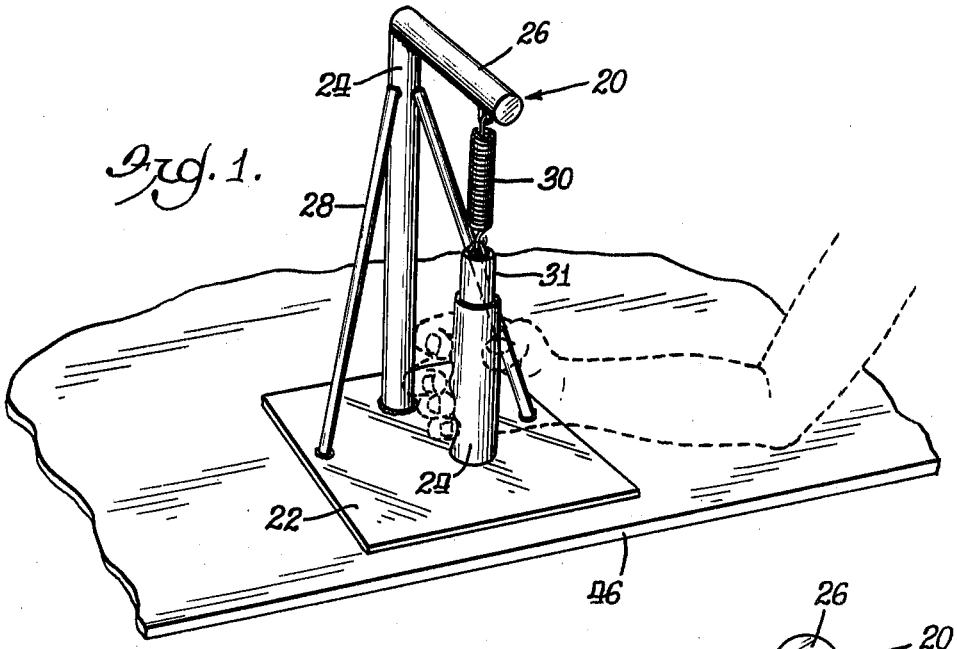
FIG. 1 is a perspective view of the exerciser illustrating it in use.

Referring now to the drawing in greater detail, the exerciser 20 has a base consisting of a flat, horizontal plate 22. A stanchion consisting of an upright post 24 is welded or otherwise fastened to the back edge portion of the plate. A forwardly extending horizontal cross-bar 26 is welded or otherwise fastened to the top of the post. Diagonal braces 28, 28 are fastened between the base plate and the post.

The foregoing components may be made of metal such as steel or aluminum, or of a suitable grade of a plastic material.

A coil spring 30 is hung from a loop 32 fastened beneath the forward end portion of the cross-bar, and a hand grip 34 is hung from the lower end of the spring.

Figure 3:
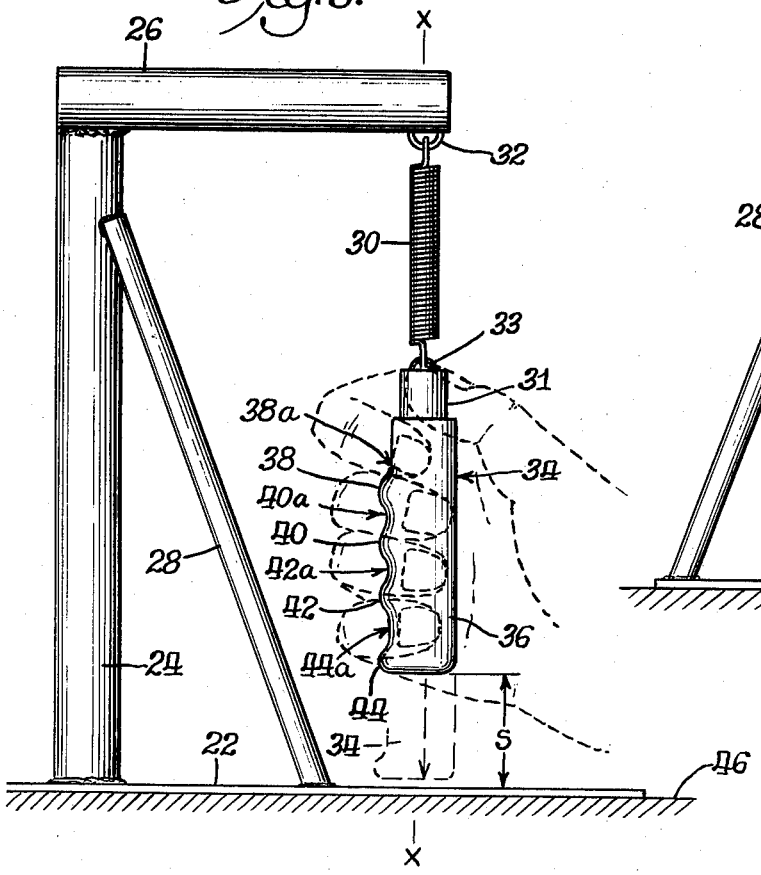
FIG. 3 is a side elevation view thereof.

The shape of the hand grip 34 is similar to that of a bicycle handlebar. It comprises a generally cylindrical or tubular body 36 with four external protuberances 38, 40, 42 and 44 defining finger-receiving recesses **38*a*, 40*a*, 42*a* and 44*a* for the first, second, third, and fourth fingers respectively (as best shown in FIG. 3). The hand grip body is mounted on a shaft or core 31 with a loop 33** engaging the lower end of the spring.

Figure 2:
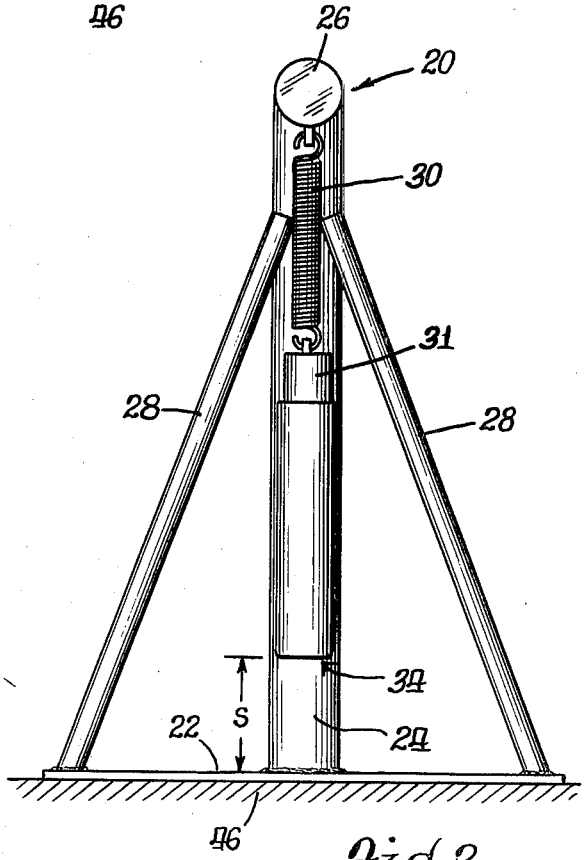
FIG. 2 is a front elevation view thereof.

The hand grip 34 will preferably be made of an elastic, readily-compressable rubber-like material. The spring and hand grip are suspended along a vertical axis X—X which intersects the base plate 22, for stability when the hand grip is pulled downwardly. As shown in FIGS. 2 and 3, the bottom end of the hand grip 34 is spaced a distance s above the base plate 22 before it is pulled downwardly during exercising use.

In use, the exerciser 20 is placed on a horizontal surface such as a table or desk top 46. The bottom surface of the base plate 22 is flat to accommodate flatwise engagement with the top 46. As shown in broken lines in FIGS. 1 and 3, the user braces his elbow against the table or desk top 46 and grasps the hand grip between the fingers, palm and thumb. Then while maintaining the elbow braced against the top, the user manipulates the hand grip 34 with a sequence of pressure applications and movements which have been described as comparable to milking a cow. He squeezes the hand grip with the individual fingers in sequence, one finger at a time, first with the hand grip between thumb and first or forefinger into recess **38*a*, then the second finger into recess 40*a*, then the third finger into recess 42*a*, and finally the fourth or small finger into recess 44*a*. Simultaneously during this sequence he pulls the hand grip 34 downward, from the solid line position to the broken line position shown in FIG. 3**. The user can feel tension developing in the shoulders, coming all the way through the biceps in the upper arm, the muscles in the forearm, and into the fingers. As a result of this manipulation, the user exercises to some extent the following twenty three muscles in the hand, arm, chest, back and shoulder:

1. Trapezius
2. Greater Pectoral
3. Smaller Pectoral
4. Deltoid
5. Larger Round
6. Coraco-brachial
7. Biceps
8. Triceps
9. Round Pronator 10. Brachial
11. Long Radial Extensor of wrist
12. Radial Flexor
13. Long Palmar
14. Ulnar Flexor
15. Superficial Flexor of Fingers
16. Common Extensor of Fingers
17. Long Adductor of Thumb
18. Short Adductor of Thumb
19. Ulnar Extensor of Wrist
20. Long Abductor of THumb
21. Extensor of Fourth Finger
22. Deep Flexor of Fingers
23. Abductor of Fourth Finger Typical of the beneficial results of this invention is the experience of a patient who could flex her hands only with great difficulty because of arthritis. Joint mobility in her hand was so limited, she could scarcely wiggle the ends of her fingers. After starting to use the exerciser by the method described above, she gradually was able to close her hand. Seven months later, she could close her hand to approximately 90% and was continuing to improve. She was able to do considerable crocheting. She made an afghan, crocheted coverings for several coat hangers, made hot pads for dishes, and was on the path to full recovery at last report. While these may appear to be simple manipulations to a person having full mobility in the finger joints, they were absolutely impossible for her to consider before use of the exerciser.

In another example, the abduction and adduction muscles in a stroke victim's hand were unbalanced in such a way that the adduction muscles would not allow her to release her grasp. After using the exerciser for approximately six weeks, she could release her hand in four of ten tests, and was continuing to show steady improvement.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The embodiments of the invention in which an exclusive property or privilege is claimed are defined as follows:

1. A finger, hand and arm muscle exerciser comprising:

a base having a horizontal bottom surface for support on a table or desk top or the like in use;

a stanchion including a post extending upwardly from the base;

a coil spring suspended at the top end from the stanchion at a location spaced above the base about a vertical axis intersecting the base inside the horizontal margins thereof to provide stability therefor when pulled downwardly;

an elongated hand grip suspended vertically from the bottom end of the spring and terminating above the base to enable downward displacement by a pull on said spring;

whereby the exerciser may be operated by grasping the hand grip and applying squeezing forces to the hand grip by the user's individual fingers in sequence while simultaneously pulling the hand grip downwardly during said sequence against the bias of the spring.

2. An exerciser according to claim 1 in which the base is a plate, the stanchion includes a post extending upwardly from an off-center portion of the plate and a crossbar extending horizontally from the post, and the coil spring is a tension spring suspended from said horizontal cross-bar.

3. An exerciser according to claim 1 in which the hand grip has four external protuberances spaced vertically apart and defining finger-receiving indentations to facilitate downward pull against the spring while applying said sequence of squeezing forces by the individual fingers.

4. An exerciser according to claim 3 in which the surface portion of the hand grip including the protuberances is made of a squeezable, rubberlike material.

5. A method of exercising a user's finger, hand and arm muscles comprising the steps of:

(a) suspending a hand grip from a spring to a position closely adjacent a horizontal surface;

(b) bracing the user's elbow on the horizontal surface while grasping the grip between the finger, palm and thumb of the corresponding hand; and (c) applying squeezing forces to the hand grip by the individual fingers in sequence while simultaneously pulling the hand grip downwardly against the bias of the spring and maintaining the elbow biased against the horizontal surface.

* * * * *